US007267107B2

(12) United States Patent
Magel

(10) Patent No.: US 7,267,107 B2
(45) Date of Patent: Sep. 11, 2007

(54) FUEL INJECTION DEVICE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 64 days.

(21) Appl. No.: 10/525,369

(22) PCT Filed: Apr. 2, 2003

(86) PCT No.: PCT/DE03/01078

§ 371 (c)(1),
(2), (4) Date: Sep. 14, 2005

(87) PCT Pub. No.: WO2004/020817

PCT Pub. Date: Mar. 11, 2004

(65) Prior Publication Data

US 2006/0144366 A1 Jul. 6, 2006

(30) Foreign Application Priority Data

Aug. 24, 2002 (DE) ..... 102 38 951

(51) Int. Cl.
*F02M 57/02* (2006.01)

(52) U.S. Cl. ..... 123/446; 123/509

(58) Field of Classification Search ..... 123/510, 123/511, 446, 467
See application file for complete search history.

(56) References Cited

U.S. PATENT DOCUMENTS

| | | | | |
|---|---|---|---|---|
| 4,289,098 | A * | 9/1981 | Norberg et al. | 123/299 |
| 5,740,775 | A * | 4/1998 | Suzuki et al. | 123/299 |
| 5,771,865 | A | 6/1998 | Ishida | |
| 6,092,509 | A * | 7/2000 | Tanabe et al. | 123/447 |
| 6,189,509 | B1 | 2/2001 | Froment | |
| 6,457,453 | B1 * | 10/2002 | Tanabe et al. | 123/300 |
| 6,513,497 | B1 | 2/2003 | Mahr et al. | |
| 6,651,626 | B2 * | 11/2003 | Rodriguez-Amaya et al. | 123/447 |
| 6,684,856 | B2 * | 2/2004 | Tanabe et al. | 123/447 |
| 6,725,840 | B1 * | 4/2004 | Mahr et al. | 123/467 |

FOREIGN PATENT DOCUMENTS

| | | |
|---|---|---|
| DE | 42 36 882 C1 | 4/1994 |
| DE | 199 39 429 A1 | 3/2001 |
| JP | 6-93936 | 4/1994 |

* cited by examiner

*Primary Examiner*—Thomas Moulis
(74) *Attorney, Agent, or Firm*—Ronald E. Greigg

(57) ABSTRACT

A fuel injection system of an internal combustion engine has, depending on the number of cylinders, at least one local pump element, assigned to each injector, of a unit fuel injector or a pump-line-nozzle system for compressing the fuel. The injector and/or the supply line to the injector form a local pressure reservoir chamber.

4 Claims, 4 Drawing Sheets

FUEL INJECTION DEVICE

CROSS-REFERENCE TO RELATED APPLICATIONS

This application is a 35 USC 371 application of PCT/DE 03/01078 filed on Apr. 2, 2003.

BACKGROUND OF THE INVENTION

1. Field of the Invention

The invention relates to an improved fuel injection system for an internal combustion engine.

2. Description of the Prior Art

For better understanding of the description and the claims, several terms will first be explained: The fuel injection system of the invention may be either stroke-controlled or pressure-controlled. Within the scope of the invention, a stroke-controlled fuel injection system is understand to mean that the opening and closing of the injection opening is effected with the aid of a displaceable nozzle needle by means of the hydraulic cooperation of the fuel pressures in a nozzle chamber and in a control chamber. A pressure reduction inside the control chamber causes a stroke of the nozzle needle. Alternatively, the deflection of the nozzle needle can be done by means of a final control element (actuator). In a pressure-controlled fuel injection system according to the invention, the nozzle needle is moved by the fuel pressure prevailing in the nozzle chamber of an injector, counter to the action of a closing force (spring), such that the injection opening is uncovered for an injection of the fuel out of the nozzle chamber into the cylinder. The pressure at which fuel emerges from the nozzle chamber into a cylinder is called the injection pressure, while system pressure is understood to mean the pressure at which fuel is available or is stored inside the fuel injection system. Fuel metering means delivering fuel to the nozzle chamber by means of a metering valve. In combined fuel metering, one common valve is used to meter various injection pressures. In the unit fuel injector (PDE), the injection pump and the injector form a unit. One such unit per cylinder is built into the cylinder head and driven by the engine camshaft, either directly via a tappet or indirectly via a tilt lever. The pump-line-nozzle system (PLD) operates by the same method. In this case, a high-pressure line leads to the nozzle chamber or nozzle holder.

For introducing fuel into direct-injection diesel engines, both pressure-controlled and stroke-controlled injection systems are known. To reduce emissions, the highest possible maximum injection pressure and a linear pressure increase are favorable. Combined unit fuel injector and pump-line-nozzle systems PDE/PLD are therefore often used, which make a high injection pressure possible.

It has also proved advantageous if the injection pressure is independent of the engine rpm and load and can be adjusted variably in the performance graph. Multiple injection is also advantageous. Some engine manufacturers therefore employ common rail systems (CRSs).

To improve the function of a PDE/PLD injection system, a stroke-controlled injector may be used. As a result, in the pumping region of the cam, a multiple injection (preinjection, main injection, postinjection) can be realized. For realizing a multiple injection, a lengthened cam stroke and pump stroke are therefore needed. Moreover, upon triggering a postinjection at high pressure, major superelevations of pressure occur, which can destroy the injection system. A postinjection is therefore possible only at low injection pressure. Moreover, no injection outside the cam pumping region is possible, which is important for a widely spaced postinjection for exhaust gas posttreatment systems.

SUMMARY AND ADVANTAGES OF THE INVENTION

To eliminate the above problems, in a fuel injection system according to the invention, the injector region is embodied as a local pressure reservoir, whose stored fuel is used both for injection and for hydraulically closing the nozzle needle. Refinements of the invention are disclosed in which a check valve downstream of the pump element prevents the high-pressure chamber of the injector from depressurizing after the termination of pumping. The stored high pressure can then be utilized for further injections. Both a postinjection at high pressure directly after the main injection can be realized, and a widely staggered postinjection. It is also possible to realize the preinjection of the next cycle from the local pressure reservoir. These multiple injections can be effected outside the cam pumping region, which has structural advantages because the pumping region is made smaller.

A further advantage is attained between the main injection and the postinjection. The pressure peaks of several hundred bar that are generated upon hydraulic needle closure can be suppressed entirely. This is achieved by means of a suitable triggering of needle closure and the pressure buildup in the pump element. The pressure buildup is triggered for only precisely long enough that the injection pressure for the main injection is generated. Upon the hydraulic closure of the nozzle needle, the pressure buildup is also terminated.

The local pressure reservoir can be depressurized slowly via a throttle, to assure a defined outset state for each injection cycle.

Depressurization via a pressure-holding valve is also possible. As a result, a certain, precisely defined residual pressure is preserved until the next injection cycle and can be used for a preinjection, for instance.

If the local pressure reservoir is embodied as large enough, it can also be used for a boot phase. The local pressure reservoir in the injector also makes a hydraulic closing force on the nozzle needle possible, so that the nozzle needle is not pressed open during the increase in cylinder pressure resulting from combustion. As a result of this hydraulic closing force, it is possible to reduce the closing spring force on the nozzle or dispense with it, which has structural advantages.

BRIEF DESCRIPTION OF THE DRAWINGS

Three exemplary embodiments of the fuel injection system of the invention described herein below, in conjunction with the drawings, in which.

DESCRIPTION OF THE PREFERRED EMBODIMENTS

Figure 1:
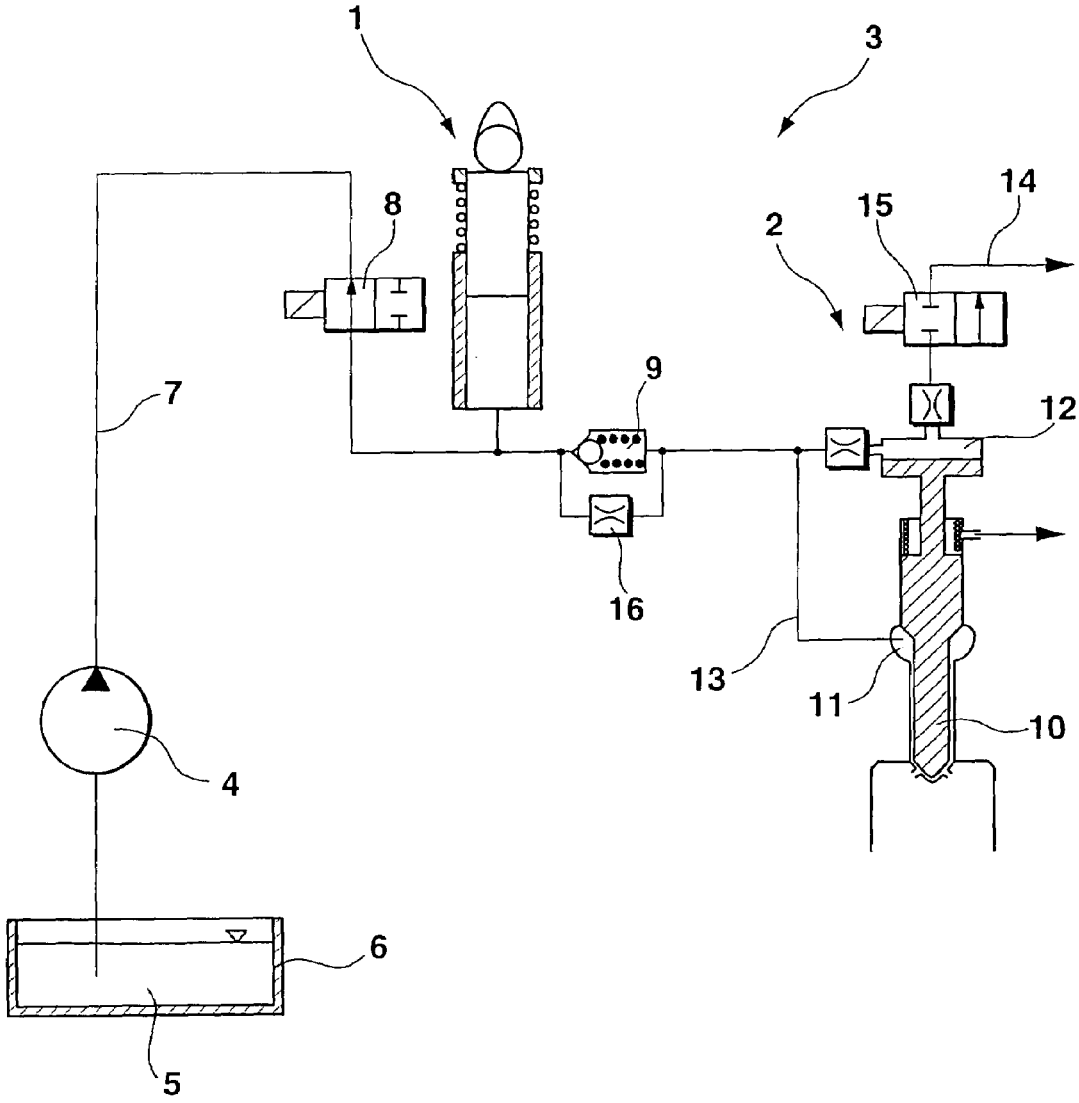
FIG. 1 is a hydraulic circuit diagram of a first fuel injection system embodying the invention.

Each cylinder is assigned one unit fuel injector (PDE) or one pump-line-nozzle system (PLD). Each unit fuel injector is composed of one pump element 1 and one injector 2. One unit fuel injector per engine cylinder is built into a cylinder head. The pump element 1 is driven by an engine camshaft either directly via a tappet or indirectly via a tilt lever. Electronic regulating devices make it possible to vary the quantity of injected fuel (injection course) in a targeted way. In the first exemplary embodiment of a stroke-controlled fuel injection system 3, shown in FIG. 1, a low-pressure pump 4 pumps fuel 5 from a tank 6 to the pump elements 1 via a delivery line 7. A control valve 8 serves the purpose of filling a pump chamber of the pump element 1. The generation of high pressure is done by closure of the control valve 8 during the cam stroke. The pressure buildup thus begins, and the fuel that is under pressure is carried to the injector 2 via a check valve 9.

The injection is effected via a metering of fuel with the aid of a nozzle needle 10 which is axially displaceable in a guide bore. A nozzle chamber 11 and a control chamber 12 are formed. Inside the nozzle chamber 11, a pressure face pointing in the opening direction of the nozzle needle 10 is exposed to the pressure prevailing there, which is delivered to the nozzle chamber 11 via a pressure line 13. Coaxially to a compression spring, a tappet also engages the nozzle needle 10 and with its face end away from the valve sealing face it defines the control chamber 12. The control chamber 12, in terms of the fuel pressure connection, has an inlet with a throttle and an outlet to a pressure relief line 14, which is controlled by a valve unit 15. Via the pressure in the control chamber 12, the tappet is urged by pressure in the closing direction. Upon actuation of the valve unit 15, the pressure in the control chamber 12 can be decreased, so that as a consequence, the pressure force in the nozzle chamber 11 acting in the opening direction on the nozzle needle 10 exceeds the pressure force acting on the nozzle needle 10 in the closing direction. The valve sealing face lifts away from the valve seat face, and fuel is injected. The end of the injection is initiated by re-actuation (closure) of the valve unit 15, which decouples the control chamber 12 from a leak fuel line 14 again, so that a pressure that is capable of moving the nozzle needle 10 in the closing direction builds up again in the control chamber 12.

The check valve 9 causes the pressure in the injector 2, after the termination of pumping by the pump element 1, not to depressurize abruptly. The pressure will merely drop somewhat, until the check valve 9 is closed. The entire volume downstream of the check valve 9 (volume of the injector 2 and of the supply line 13) thus acts as a local pressure reservoir for the injector 2. As a result of the hydraulically controlled injector 2, the nozzle remains closed. With the aid of the stored pressure, further injections can ensue. This local pressure reservoir is especially suitable for small injection quantities, of the kind typically involved in a postinjection and a preinjection. To set the pressure in the injector region to a defined level until the next injection and thus to avoid tolerance problems, a throttle 16 is connected parallel to the check valve 9. This throttle is dimensioned such that the pressure in the local pressure reservoir decreases slowly and by the next injection cycle is depressurized down to the low pressure level in the pump chamber.

Figure 2:
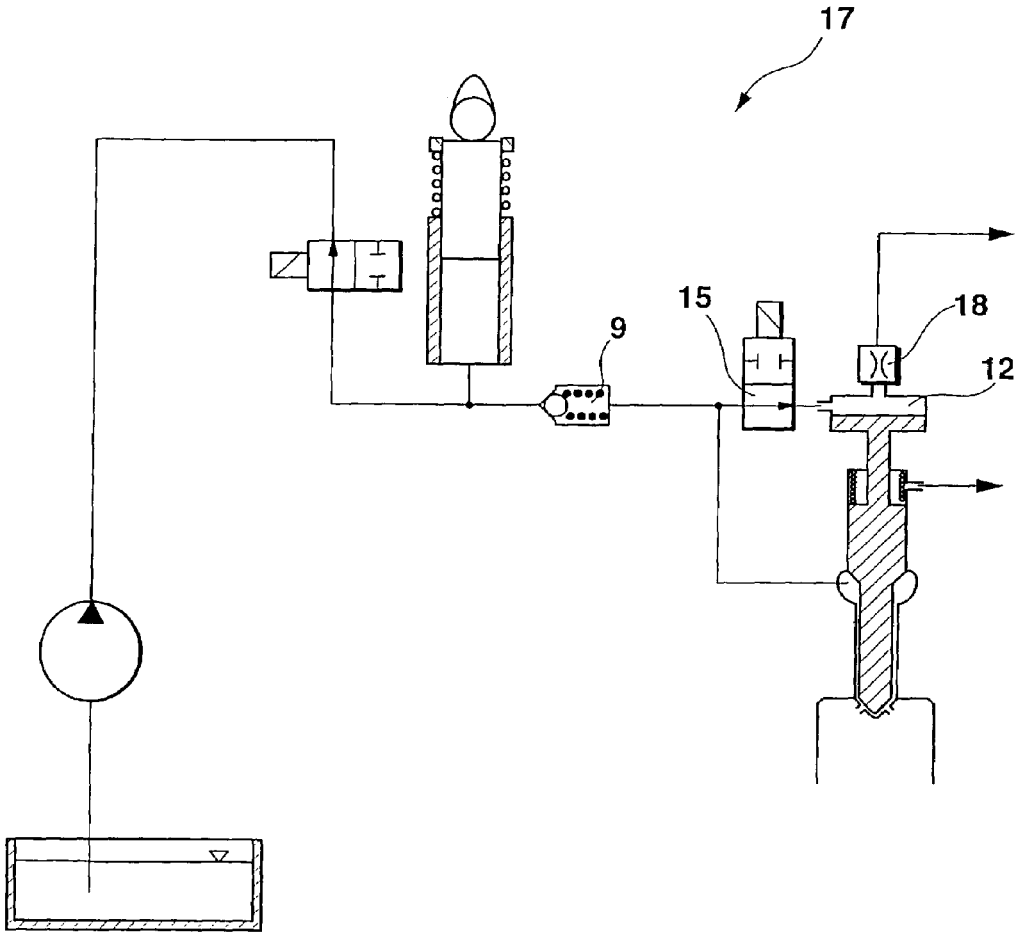
FIG. 2 is a hydraulic circuit diagram of a second fuel injection system.

In FIG. 2, a fuel injection system 17 can be seen in which the control valve 15 for connecting the control chamber 12 is located in the inlet. If the valve 15 is opened, the result in the control chamber 12, because of the throttle 18, is a control pressure, and the nozzle remains closed. If the valve 15 is closed, then the control chamber 12 depressurizes via a throttle 18, and the nozzle opens. In this variant, the throttle 18 simultaneously takes on the task of depressurizing the local reservoir slowly until the next injection, since a fuel flow via the throttle 18 exists when the injector 2 is closed.

Figure 3:
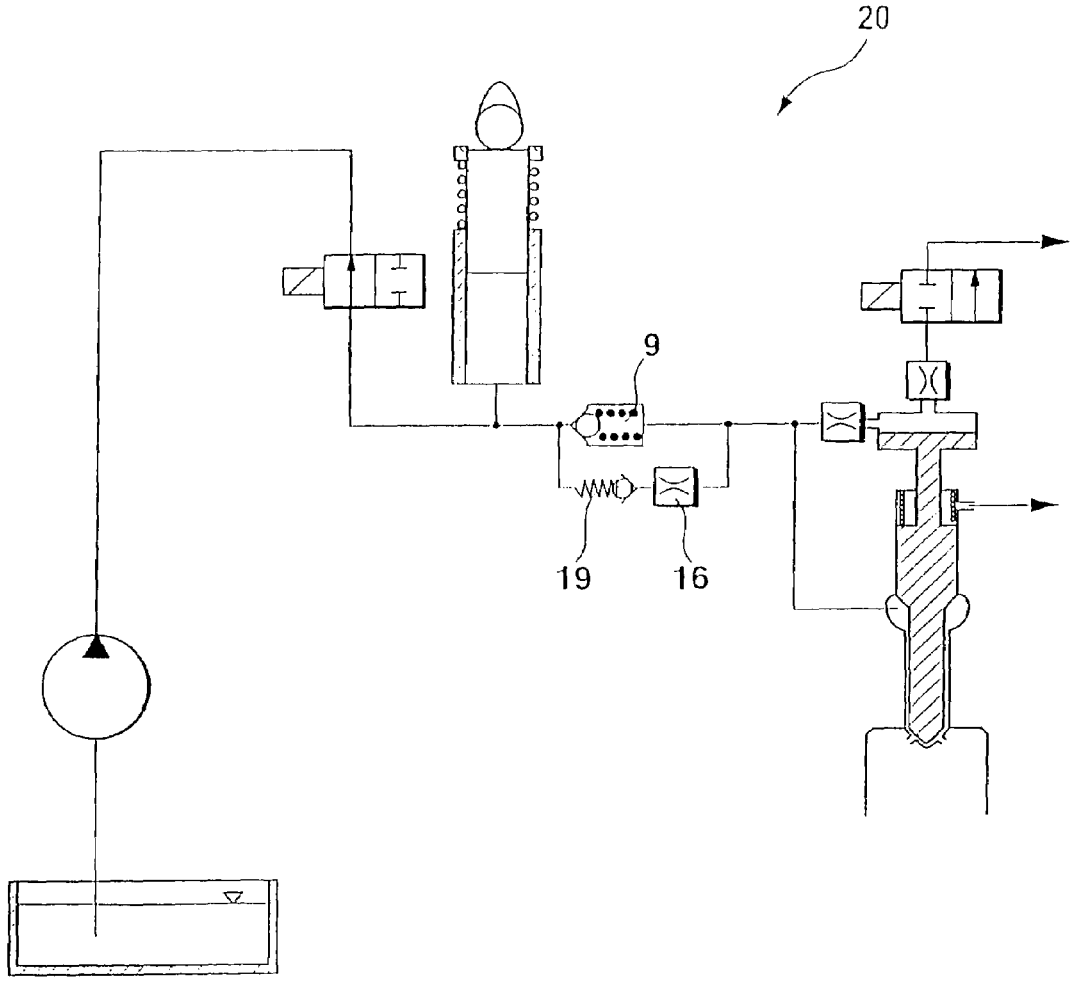
FIG. 3 is a hydraulic circuit diagram of a third fuel injection system.

FIG. 3 illustrates a further embodiment by means of a fuel injection system 20. Once again, the throttle 16 is provided parallel to the check valve 9 and slowly decreases the pressure in the injector region after the injection. In addition, the throttle 16 here also has a pressure-holding valve 19 connected in series with it. Thus the pressure decrease is effected only down to an exactly defined standing pressure p(s) (for instance, 300 bar), in the line. Thus the result in the local pressure reservoir chamber is a defined pressure level which can be utilized for further injections. This is preferably a preinjection. However, it is also possible to realize the boot phase of a main injection from this pressure reservoir. Moreover, the hydraulic efficiency of the system is increased, since the injector region is no longer completely depressurized.

Figure 4:
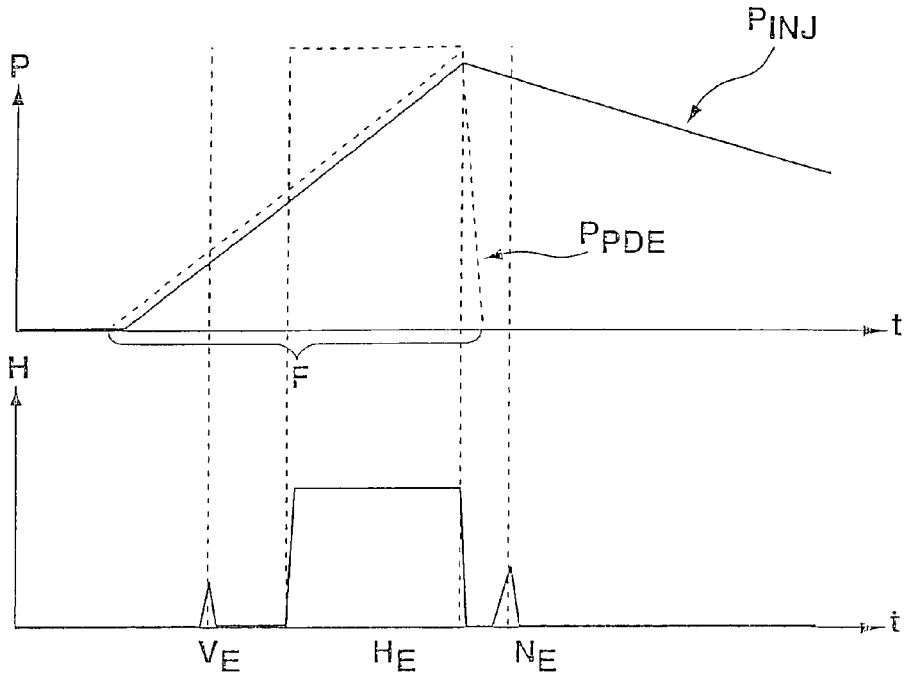
FIG. 4 is a first pressure course and needle stroke of a fuel injection system of FIG. 1.

FIG. 4 schematically shows one possible course over time of the pressure P in the injector ($P_{INJ}$) and in the pump element ($P_{PDE}$), and the needle stroke H at a preinjection (VE), main injection (HE), and postinjection (NE) cycle. The pump pumping region F is also shown.

Figure 5:
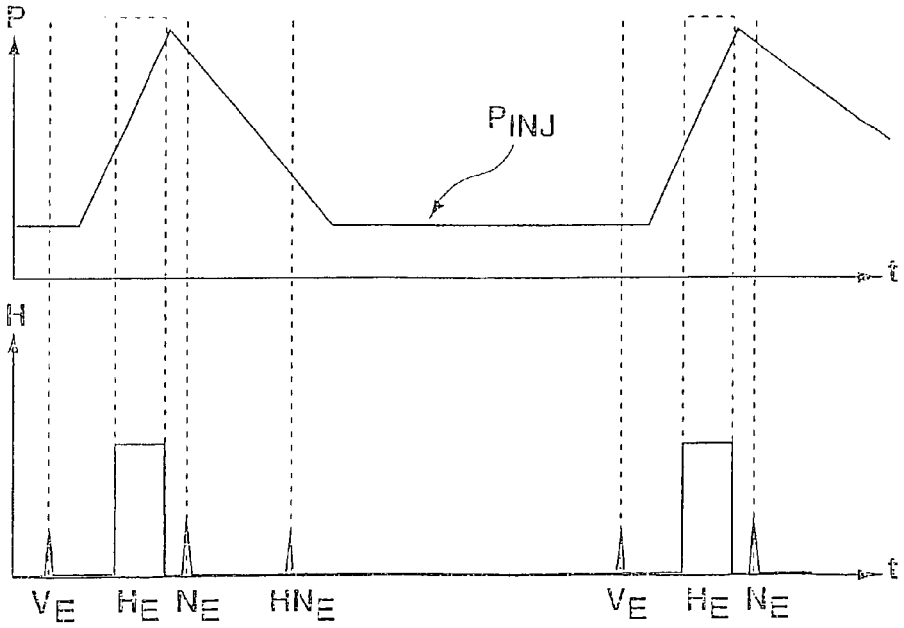
FIG. 5 is a second pressure course and needle stroke of a fuel injection system of FIG. 3.

FIG. 5 schematically shows one possible course of pressure P over time in the injector ($P_{INJ}$) and in the pump element ($P_{PDE}$), and the needle stroke H at a preinjection (VE), main injection (HE), and postinjection (NE) cycle and a staggered postinjection (ANE). What is shown is a detail over two injection cycles. It can be seen that in the entire period of time between the main injections, an injection from the local pressure reservoir is possible. Especially, a widely spaced postinjection and a very early preinjection are possible.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection system (3, 17, 20) of an internal combustion engine, the system comprising at least one local cam driven pump element (1) per engine cylinder, associated with each injector (2), of a unit fuel injector or a pump-line-nozzle system for compressing the fuel, a supply line from the pump element supplying fuel to the injector (2), the injector (2) and/or the supply line to the injector (2) forming a local pressure reservoir chamber, a check valve (9) integrated into the supply line from the pump element (1) to the injector (2), a control valve (8) located upstream of the cam driven pump element for generating high pressure in the closed state of the control valve (8) during the cam stroke, and a throttle (16; 18) for controlling the pressure decrease of a nozzle chamber (11) of the injector.

2. The fuel injection system according to claim 1, further comprising a throttle (16) connected parallel to the check valve (9).

3. The fuel injection system according to claim 2, further comprising a pressure-holding valve (19) connected in series with the throttle (16).

4. The fuel injection system according to claim 1, wherein the supply line from the pump element (1) to the injector (2) is connected to a control chamber of the injector (2) via a valve unit (15).

* * * * *